US011255116B2

(12) United States Patent
Zhang et al.

(10) Patent No.: US 11,255,116 B2
(45) Date of Patent: Feb. 22, 2022

(54) LEFT-RIGHT DOOR OPENING MECHANISM FOR A REFRIGERATOR

(71) Applicant: QINGDAO HAIER JOINT STOCK CO., LTD., Qingdao (CN)

(72) Inventors: Hao Zhang, Qingdao (CN); Enpin Xia, Qingdao (CN); Xiaobing Zhu, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 422 days.

(21) Appl. No.: 16/302,098

(22) PCT Filed: Dec. 29, 2016

(86) PCT No.: PCT/CN2016/112821
§ 371 (c)(1),
(2) Date: Nov. 15, 2018

(87) PCT Pub. No.: WO2017/206502
PCT Pub. Date: Dec. 7, 2017

(65) Prior Publication Data

US 2019/0145140 A1 May 16, 2019

(30) Foreign Application Priority Data

May 31, 2016 (CN) ..... 201610379789.5

(51) Int. Cl.
*E05D 7/02* (2006.01)
*E05D 15/50* (2006.01)
(Continued)

(52) U.S. Cl.
CPC ..... *E05D 7/02* (2013.01); *E05D 3/02* (2013.01); *E05D 15/505* (2013.01); *E05F 1/00* (2013.01);
(Continued)

(58) Field of Classification Search
CPC ... F25D 2323/022; E05D 7/02; E05D 15/505; E06B 2003/7055
(Continued)

(56) References Cited

U.S. PATENT DOCUMENTS 3,308,579 A * 3/1967 Thams ..... E05D 15/5208 49/192
4,514,021 A 4/1985 Sundermeier et al.
(Continued)

FOREIGN PATENT DOCUMENTS

CN 1207488 A 2/1999
CN 1465837 A 1/2004
(Continued)

*Primary Examiner* — Gregory J Strimbu
(74) *Attorney, Agent, or Firm* — Cheng-Ju Chiang

(57) ABSTRACT

A mechanism for opening a door of a refrigerator from either the left side or the right side of the door includes a pair of first modules arranged symmetrically about the center line of the door on the left side and the right side of the door, and a pair of second modules arranged symmetrically about the center line of a refrigerator body on the left side and the right side of the refrigerator body. Each first module comprises an opening and a gear which is rotatably mounted on the door. Each second module comprises a rack configured to be engaged with one of the gears, a hinge, a rotating shaft and a guiding slider for guiding a rotation of one of the gears.

7 Claims, 11 Drawing Sheets

(51) Int. Cl.

| | |
|---|---|
| ***F25D 23/02*** | (2006.01) |
| ***E05D 3/02*** | (2006.01) |
| ***E05F 1/00*** | (2006.01) |
| ***E06B 3/40*** | (2006.01) |
| *E06B 3/70* | (2006.01) |

(52) U.S. Cl.
CPC ..... *E06B 3/40* (2013.01); *F25D 23/028* (2013.01); *E05Y 2201/712* (2013.01); *E05Y 2201/722* (2013.01); *E05Y 2900/31* (2013.01); *E06B 2003/406* (2013.01); *E06B 2003/7055* (2013.01); *F25D 2323/022* (2013.01)

(58) Field of Classification Search
USPC ..... 49/192, 193
See application file for complete search history.

(56) References Cited

U.S. PATENT DOCUMENTS

| | | | | | |
|---|---|---|---|---|---|
| 5,173,992 | A * | 12/1992 | Aihara | B60R 7/04 | 16/232 |
| 5,675,934 | A * | 10/1997 | Park | E05D 15/505 | 49/193 |
| 7,913,355 | B2 * | 3/2011 | Choi | E05D 15/505 | 16/230 |
| 2007/0256447 | A1 * | 11/2007 | Leimkuehler | E05D 15/505 | 62/440 |

FOREIGN PATENT DOCUMENTS

| | | | |
|---|---|---|---|
| CN | 202692585 | U | 1/2013 |
| CN | 203964529 | U | 11/2014 |
| CN | 104328966 | A | 2/2015 |
| CN | 105509396 | A | 4/2016 |
| CN | 106052268 | A | 10/2016 |
| JP | 2003-262456 | A | 9/2003 |
| JP | 2006-57904 | A | 3/2006 |
| WO | 2007/018395 | A1 | 2/2007 |

* cited by examiner

LEFT-RIGHT DOOR OPENING MECHANISM FOR A REFRIGERATOR

CROSS REFERENCE OF THE RELATED APPLICATIONS

This application is a 35 U.S.C. § 371 National Phase conversion of International (PCT) Patent Application No. PCT/CN2016/112821, filed on Dec. 29, 2016, which claims the priority of Chinese Patent Application No. 201610379789.5 filed on May 31, 2016 with a title of "Left-Right Door Opening Mechanism and Refrigerator", the entire content of which is hereby incorporated in this application by reference. The PCT International Patent Application was filed and published in Chinese.

TECHNICAL FIELD

The present invention relates to the technical field of household appliances, and in particular, to a left-right door opening mechanism and a refrigerator.

BACKGROUND

At present, for a commercially available refrigerator, a door is generally opened from the left side, and also has the function of opening from the right side, but it is necessary for an after-sales engineer to visit to replace a hinge or change the position of the hinge. This method has higher skill requirements for after-sales maintenance personnel and also reduces the use experience of a user.

In view of the above problems, it is necessary to provide a left-right door opening mechanism and a refrigerator.

SUMMARY

In view of the defects of the prior art, the technical problem to be solved by the present invention is to provide a left-right door opening mechanism and a refrigerator, which are capable of opening a door of the refrigerator from the left side or the right side.

In order to solve the above technical problem, the technical solution of the present invention is implemented as follows.

A left-right door opening mechanism comprises first modules symmetrically arranged on the left side and the right side of a door body, and second modules symmetrically arranged on the left side and the right side of a refrigerator body, wherein each first module comprises a mounting bottom plate and gears rotatable on the mounting bottom plate; each first module is provided with an opening; each second module comprises a rack in transmission with the corresponding gear, a hinge used for fixing the rack, a rotating shaft mounted in cooperation with the hinge, and a guiding slider fixedly located below the hinge; when the left-right door opening mechanism is in a locked state, the rotating shafts are accommodated in the openings; the first modules fixedly cooperate with the second modules; when the left-right door opening mechanism is opened from one side, the gear is driven by the rack, and the opening of the first module on this side is gradually opened, such that the rotating shaft on this side is disengaged from the first module; meanwhile, the opening of the first module on the other side is in a locked state to accommodate the rotating shaft on this side.

As an improvement of the present invention, the gears on both sides of the mounting bottom plate are symmetrically mounted; the racks, the hinges, the rotating shafts and the guiding sliders in the second modules are symmetrically mounted; when the left-right door opening mechanism is locked or opened, the two gears rotate in the same direction.

As a further improvement of the present invention, the openings include a first opening on the mounting bottom plate and a second opening on the gear; the mounting bottom plate is provided with a first main body portion having an arc shape; the first main body portion has the first opening that faces the rotating shaft; the gear is provided with a second main body portion having an arc shape; the second main body portion rotates around the first main body portion on the mounting bottom plate; the second main body portion has the second opening that faces the rotating shaft.

As a further improvement of the present invention, a guiding member which extends downwards from the second main body portion is arranged on the gear; the mounting bottom plate is provided with a first guiding groove having an arc shape; the guiding member on the gear moves along the first guiding groove on the mounting bottom plate.

As a further improvement of the present invention, a first attracting portion and a second attracting portion are arranged on two ends of the first guiding groove respectively; when the guiding member is adjacent to the first attracting portion or the second attracting portion, the first attracting portion or the second attracting portion attracts the guiding member.

As a further improvement of the present invention, a first tooth portion and a second tooth portion which are meshed with each other are arranged on the gear and the rack respectively, wherein the first tooth portion is arranged outside the second main body portion; the rack is fixedly arranged; when the gear moves relative to the rack, the first tooth portion rotates to change the orientation of the second opening on the gear.

As a further improvement of the present invention, a buckling portion for a clamping purpose and a limiting portion are arranged on the gear and the rack respectively; when the left-right door opening mechanism is locked, the buckling portion is fixedly clamped with the limiting portion; when the left-right door opening mechanism is opened from one side, the buckling portion and the limiting portion on this side are separated from each other.

As a further improvement of the present invention, the guiding slider is provided with a plurality of limiting members or guiding grooves which are used for limiting or guiding the gear and/or the rack, and a third attracting portion for attracting the rack.

As a further improvement of the present invention, the hinge is mounted between the rack and the guiding slider; the hinge is provided with a plurality of accommodating grooves and/or guiding grooves so as to limit the rack and the guiding slider and/or guide the mounting bottom plate.

Correspondingly, the present invention further discloses a refrigerator which comprises the above-mentioned left-right door opening mechanism.

The present invention has the following beneficial effects:

the first modules and the second modules, which cooperate with each other, are arranged on two sides of the door body and on two sides of the refrigerator body respectively, and therefore, the door can be opened from the left side and the right side at the same time;

it is ensured that the door opening and closing process is smooth and free of blocking and impact noise. The door body is unlikely to fall off during the opening and closing process, and provides an excellent use experience for a user.

DETAILED DESCRIPTION

To make the objects, technical solutions and advantages of the present invention clearer, the specific embodiments of the present invention are described in detail with reference to the accompanying drawings. Examples of these preferred embodiments are given in the accompanying drawings. The embodiments of the present invention shown in the accompanying drawings and described based on the accompanying drawings are only exemplary and are not intended to limit the present invention.

The terms "left", "right", "left side", "right side", and the like as used here, which denote spatial relative positions, describe the relationship of a component relative to another component in the accompanying drawings for the purpose of illustration. The terms of the spatial relative positions may be intended to include different orientations of the device in use or operation other than the orientations shown in the accompanying drawings. For example, the units that are described as being located on the "right side" of other units or features will be located on the "left side" of other units or features if the device in the accompanying drawings is turned upside down. Thus, the exemplary term "right side" can encompass both the orientations of left side and right side. The device may be otherwise oriented (rotated by 90 degrees or facing other directions) and the space-related descriptors used here are interpreted accordingly.

Figure 1:
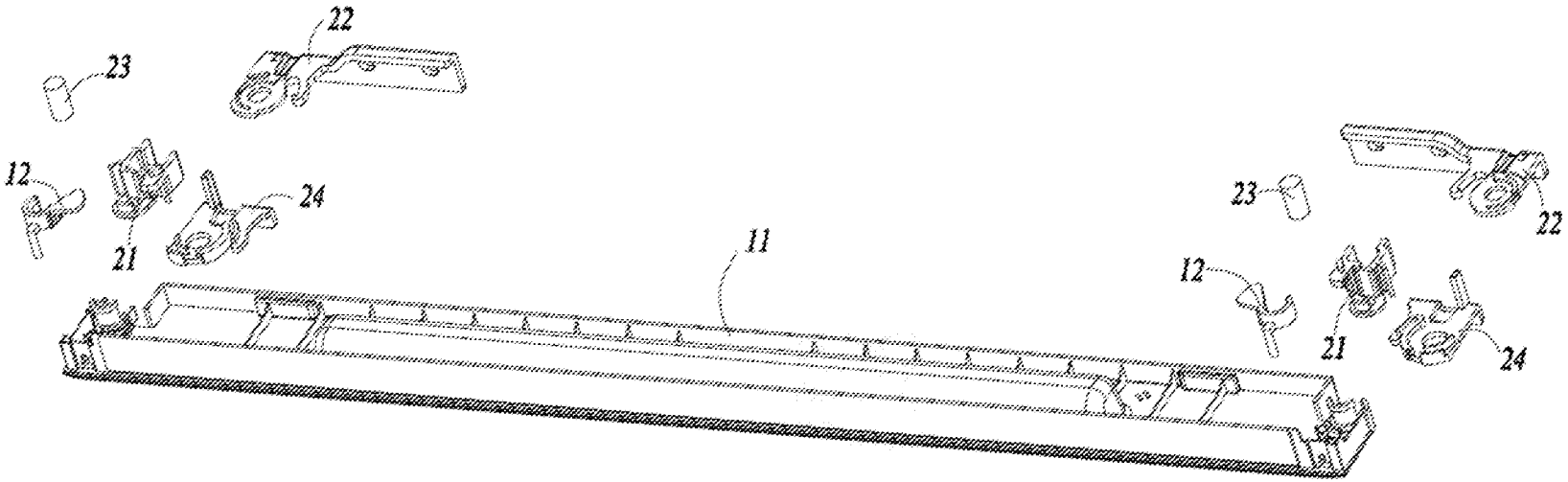
FIG. 1 illustrates an exploded schematic structural diagram of a left-right door opening mechanism in a specific embodiment of the present invention.
Figure 2:
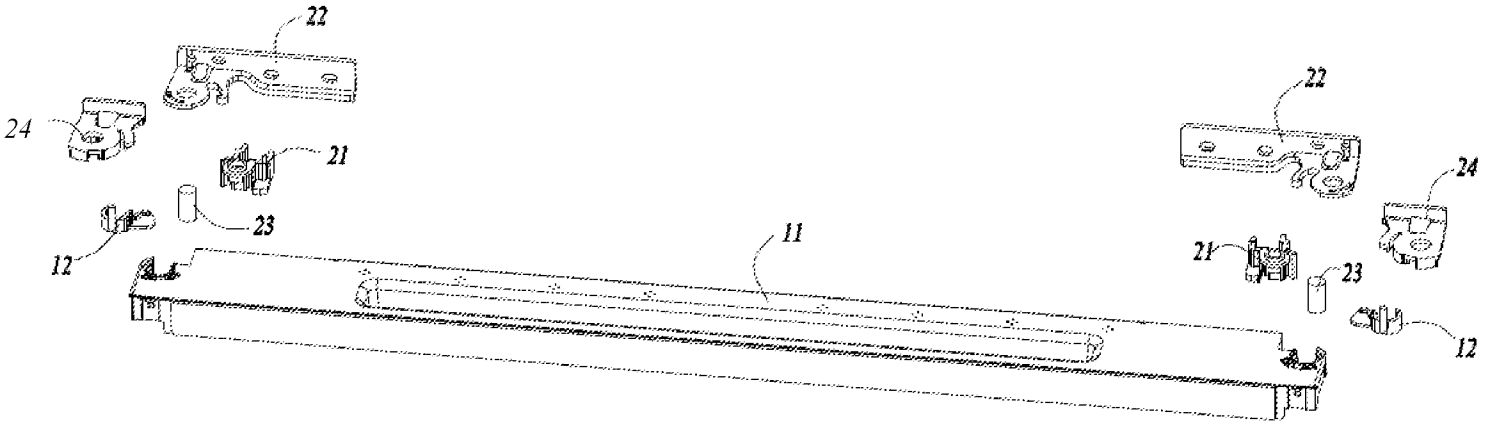
FIG. 2 illustrates an exploded schematic structural diagram of the left-right door opening mechanism from another visual angle in a specific embodiment of the present invention.

As shown in FIGS. 1 and 2, a left-right door opening mechanism in a specific embodiment of the present invention comprises first modules symmetrically arranged on the left side and the right side of a door body, and second modules symmetrically arranged on the left side and the right side of a refrigerator body. Each first module comprises a gear 12 rotatable on a mounting bottom plate 11. Each first module is provided with an opening. Each second module comprises a rack 21 in transmission with the corresponding gear, a hinge 22 used for fixing the rack, a rotating shaft 23 mounted in cooperation with the hinge, and a guiding slider 24 fixedly located below the hinge.

When the left-right door opening mechanism in the present invention is in a locked state, the rotating shafts 23 are accommodated in the openings. The first modules fixedly cooperate with the second modules. When the left-right door opening mechanism is opened from one side, the gear 12 is driven by the rack 21, and the opening of the first module on this side is gradually opened, such that the rotating shaft 23 on this side is disengaged from the first module. Meanwhile, the opening of the first module on the other side is in a locked state to accommodate the rotating shaft on this side.

The mounting bottom plate 11 in the first module is fixedly mounted on the door body. The gears 12 on both sides of the mounting bottom plate 11 are symmetrically mounted. The racks 21, the hinges 22, the rotating shafts 23 and the guiding sliders 24 in the second modules are symmetrically mounted. When the left-right door opening mechanism is locked or opened, the two gears 12 rotate in the same direction.

The left-right door opening mechanism in the present embodiment will be described below in detail in conjunction with specific components in the first modules and the second modules.

Figure 3A:
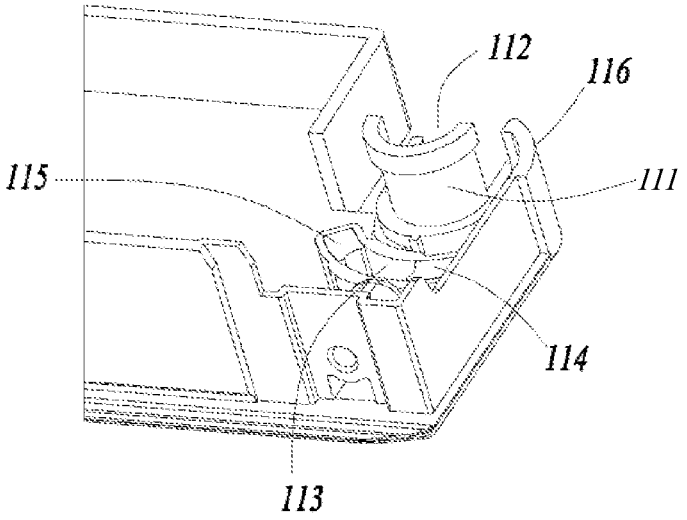
FIG. 3*a* illustrate illustrates a local stereoscopic schematic structural diagram of a mounting bottom plate in a specific embodiment of the present invention.
Figure 3B:
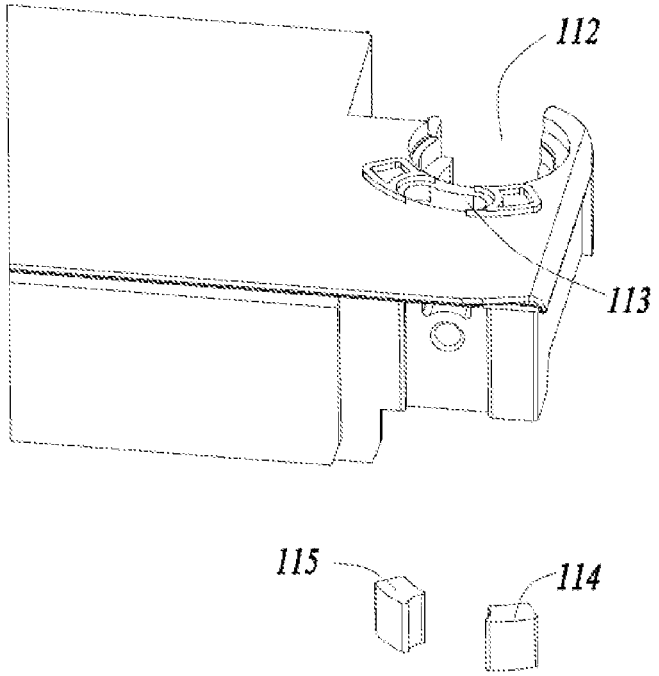
FIG. 3*b* illustrates a local stereoscopic schematic structural diagram of a mounting bottom plate from another visual angle in a specific embodiment of the present invention.

As shown in FIGS. 3*a* and 3*b*, the mounting bottom plate 11 in the present embodiment is arranged longitudinally. A first main body portion 111 having an arc shape is arranged on two sides of the mounting bottom plate respectively. Each main body portion has a first opening 112 that faces the rotating shaft. The first opening should ensure that the rotating shaft can be disengaged from the first main body portion, and therefore the distance at the opening of the first main body portion 111 should be greater than or equal to the diameter of the rotating shaft. A first guiding groove 113 which has an arc shape and is used for guiding and limiting the gear is arranged on the back of the first main body portion 111, which is away from the first opening 112.

Further, a first attracting portion 114 and a second attracting portion 115 are arranged on two ends of the first guiding groove 113 respectively. When the guiding member is adjacent to the first attracting portion or the second attracting portion, the first attracting portion 114 or the second attracting portion 115 attracts the gear.

In addition, a guiding portion 116 having an arc shape is further arranged on the side edge of the mounting bottom plate 11. The guiding portion 116 is matched with the rack 21 and used for guiding and limiting the rack and the mounting bottom plate.

Figure 4A:
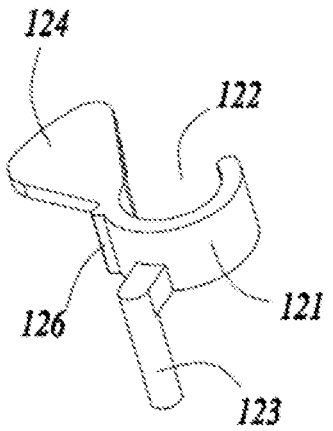
FIG. 4*a* illustrates a stereoscopic schematic structural diagram of a gear in a specific embodiment of the present invention.
Figure 4B:
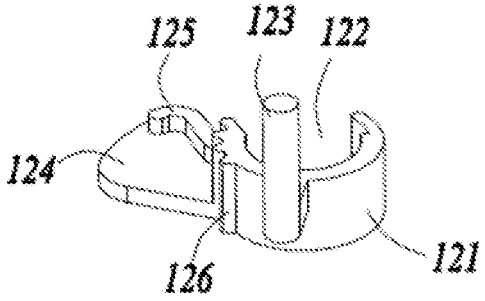
FIG. 4*b* illustrates a stereoscopic schematic structural diagram of a gear from another visual angle in a specific embodiment of the present invention.

As shown in FIGS. 4*a* and 4*b*, the gear 12 in the present embodiment comprises a second main body portion 121 having an arc shape. The second main body portion 121 rotates around the first main body portion 111 on the mounting bottom plate 11. Preferably, as shown in FIG. 3*a*, an area in the middle of the first main body portion 111 on the mounting bottom plate 11 is recessed. The second main body portion 121 is mounted in this recessed area to ensure that the second main body portion 121 that is in rotation is not disengaged from the first main body portion 111. The second main body portion 121 has a second opening 122 that faces the rotating shaft. The second opening also should ensure that the rotating shaft can be disengaged from the second main body portion, and therefore the distance at the second opening should be greater than or equal to the diameter of the rotating shaft.

A guiding member 123 that extends downwards from the second main body portion 121 is arranged on the gear 12. The guiding member 123 on the gear moves along the first guiding groove 113 on the mounting bottom plate 11. Preferably, the guiding member is made of a metal material (e.g., iron) that can be attracted by a magnet. The first attracting portion 114 and the second attracting portion 115 inside the first guiding groove 113 on the mounting bottom plate 11 are magnets. When the guiding member 123 moves to the vicinity of the first attracting portion 114, the first attracting portion 114 will provide a magnetic force to attract the guiding member. Similarly, when the guiding member 123 moves to the vicinity of the second attracting portion 115, the second attracting portion 115 will provide a magnetic force to attract the guiding member. Of course, in other embodiments, expect for the guiding member that is made of the metal material, the entire gear may also be made of this metal material, and the purpose of attracting the guiding member 123 by the first attracting portion 114 and the second attracting portion 115 may also be achieved.

A first tooth portion 126 is also arranged outside the second main body portion 121 of the gear 12. A rotation is transmitted to the gear 12 through engagement between the first tooth portion 126 and a second tooth portion on the rack. In addition, a first extension portion 124 which extends horizontally outwards from the main body portion is also arranged above the gear 12. A buckling portion 125 which is used for being clamped with a limiting portion on the rack is arranged below the first extension portion 124. The assembly and principle of the first tooth portion 126 and the buckling portion 125 will be described in detail in the section of the rack.

Figure 5A:
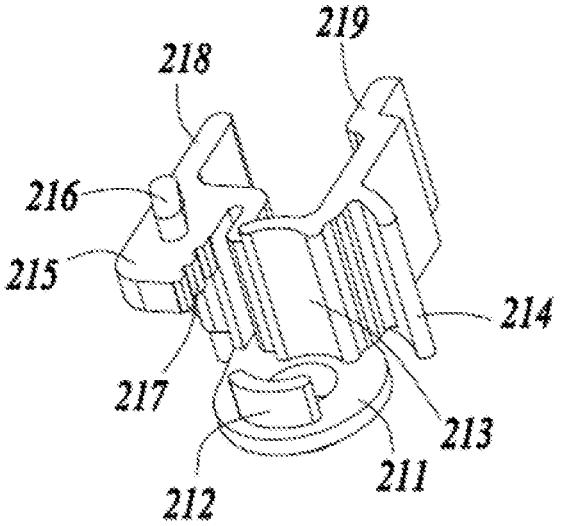
FIG. 5*a* illustrates a stereoscopic schematic structural diagram of a rack in a specific embodiment of the present invention.
Figure 5B:
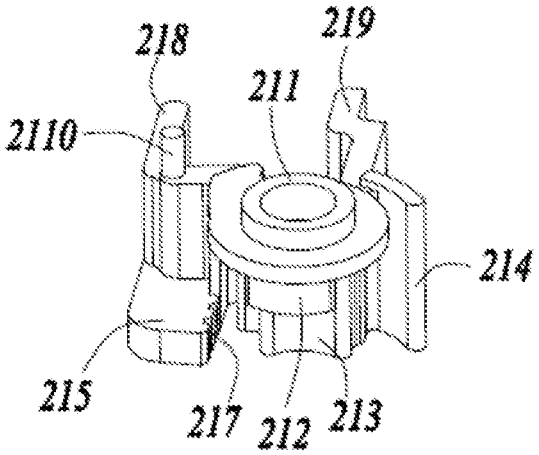
FIG. 5*b* illustrates a stereoscopic schematic structural diagram of a rack from another visual angle in a specific embodiment of the present invention.

As shown in FIGS. 5*a* and 5*b*, the rack 21 comprises a third main body portion 211 which is circularly arranged, and a first stop portion 212 and a second stop portion 213 which are vertically mounted on the third main body portion 211. The first stop portion 212 is arranged in an arc shape. The interior of the second stop portion 213 is also partially arranged in an arc shape. The first stop portion 212 is lower than the second stop portion 213. The rotating shaft 23 is mounted between the first stop portion 212 and the second stop portion 213.

A second extension portion 215, a third extension portion 218 and a fourth extension portion 219 are provided on the second stop portion 213, and the second extension portion 215, the third extension portion 218 and the fourth extension portion 219 are extended outwards from the second stop portion 213. The second extension portion 215 is located next to the side of the rotating shaft 23. A second tooth portion 217 is arranged on one side of the second extension portion 215 to face the rotating shaft 23. The second tooth portion 217 is matched with the first tooth portion 126. The rack is fixedly mounted on the refrigerator body. If an outward force is applied to the door body in this case, the gear will move outwards. Meanwhile, the gear will rotate clockwise through the transmission of the first tooth portion and the second tooth portion to gradually change an opening direction of the second opening 122.

The third extension portion 218 and the fourth extension portion 219 extend away from the rotating shaft. The third extension portion 218 abuts against the mounting bottom plate 11. The fourth extension portion 219 abuts against the guiding slider 24. The rack is mounted between the mounting bottom plate and the guiding slider by means of the third extension portion 218 and the fourth extension portion 219.

Further, a third stop portion 214 having an arc shape is further arranged on the side of the fourth extension portion 219. The third stop portion 214 is matched with the guiding portion 116 on the mounting bottom plate 11 so as to control a movement direction of the mounting bottom plate 11.

By reference to FIG. 5*a* and as shown in FIG. 4*b*, in the present embodiment, the limiting portion 216 is arranged on the upper surface of the second extension portion 215. The limiting portion 216 is matched with the buckling portion 125 located below the first extension portion 124 of the gear 12. The buckling portion 125 is L-shaped. The limiting portion 216 may be fixedly clamped inside the buckling portion 125. When the left-right door opening mechanism is locked, the buckling portions on two ends are fixedly clamped with the corresponding limiting portions 216. When the door is opened from one side, the first tooth portion 125 on the gear drives the gear to rotate gradually, the buckling portion 125 rotates as the gear rotates and is gradually separated from the limiting portion 216, such that the gear on the door body may be separated from the rack on the refrigerator body. In the same way, when the door is locked from one side, the buckling portion 125 on this side rotates reversely along with the gear, till the buckling portion 125 is fixedly clamped with the limiting portion 216, and therefore the effect of fixing the gear and the rack can be achieved.

It should be understood that the limiting portion 216 in the present embodiment is arranged on the rack, and the buckling portion 125 is arranged on the gear. In other embodiments, the limiting portion 216 may also be arranged on the gear, but the buckling portion 125 is arranged on the rack, and the mounting relationship thereof corresponds to that in the present embodiment. Similarly, the purpose of clamping the gear and the rack can be achieved, and will not be described in detail again.

Figure 6A:
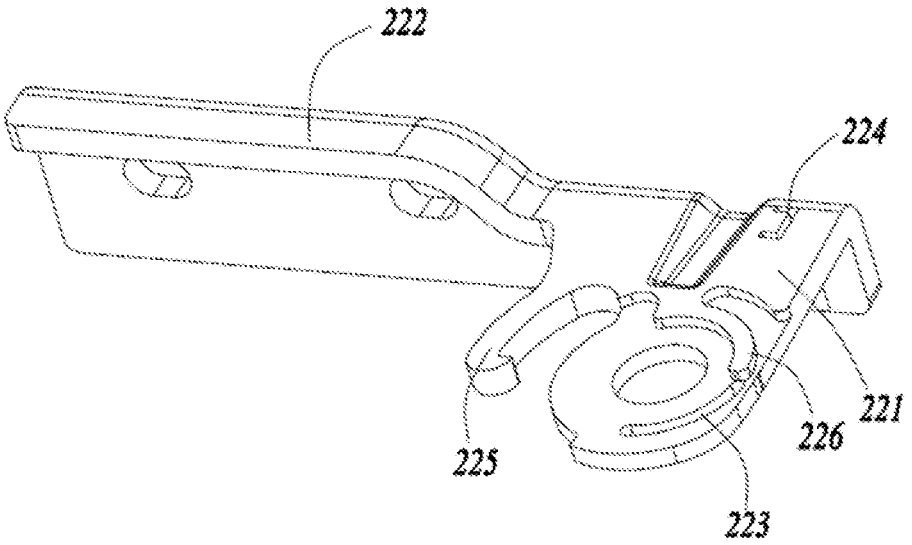
FIG. 6*a* illustrate illustrates a stereoscopic schematic structural diagram of a hinge in a specific embodiment of the present invention.
Figure 6B:
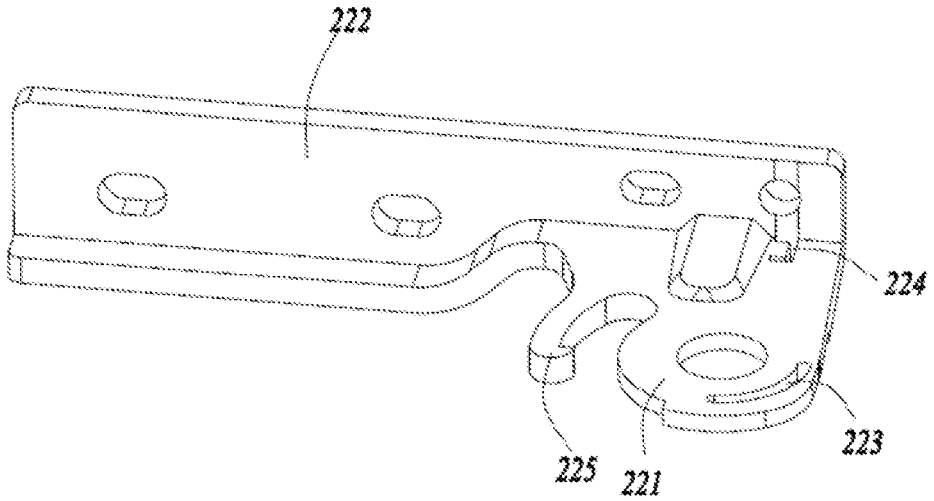
FIG. 6*b* illustrates a stereoscopic schematic structural diagram of a hinge from another visual angle in a specific embodiment of the present invention.

As shown in FIGS. 6*a* and 6*b*, the hinge 22 in the present embodiment comprises a fourth main body portion 221 and a side portion 222 which is perpendicular to the main body portion. The fourth main body portion 221 is fixedly mounted on the lower surface of the mounting bottom plate 11. The side portion 222 is fixedly mounted on the side edge of the mounting bottom plate 11. A first limiting member 226 having an arc shape is arranged on the fourth main body portion 221. The first limiting member 226 is used for limiting the bottom surface of the rack. Meanwhile, the fourth main body portion 221 is further provided with a first accommodating groove 223 having an arc shape and a second accommodating groove 224 which is in a shape of "Π". A second limiting member 225 is also arranged on the side of the fourth main body portion 221. The first accommodating groove 223, the second accommodating groove 224 and the second limiting member 225 are used for guiding or limiting the structure on the guiding slider, and will be described in detail in the guiding slider.

Figure 7A:
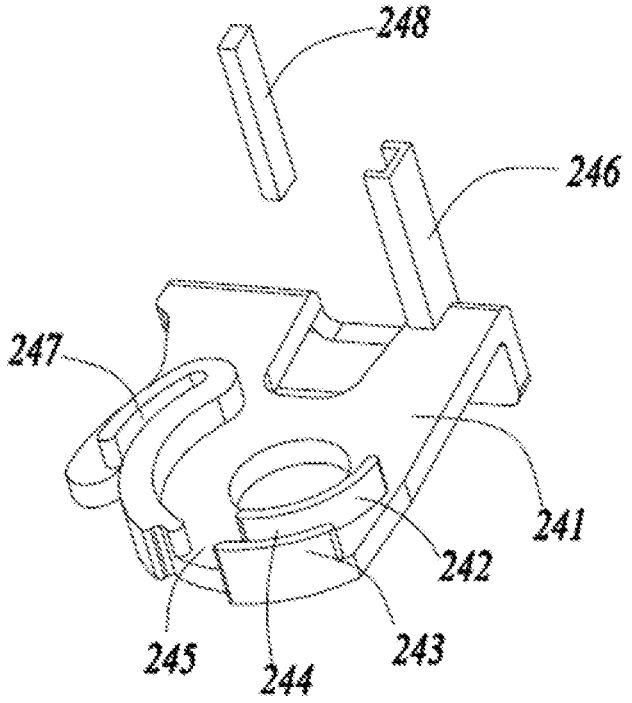
FIG. 7*a* illustrates a stereoscopic schematic structural diagram of a guiding slider in a specific embodiment of the present invention.
Figure 7B:
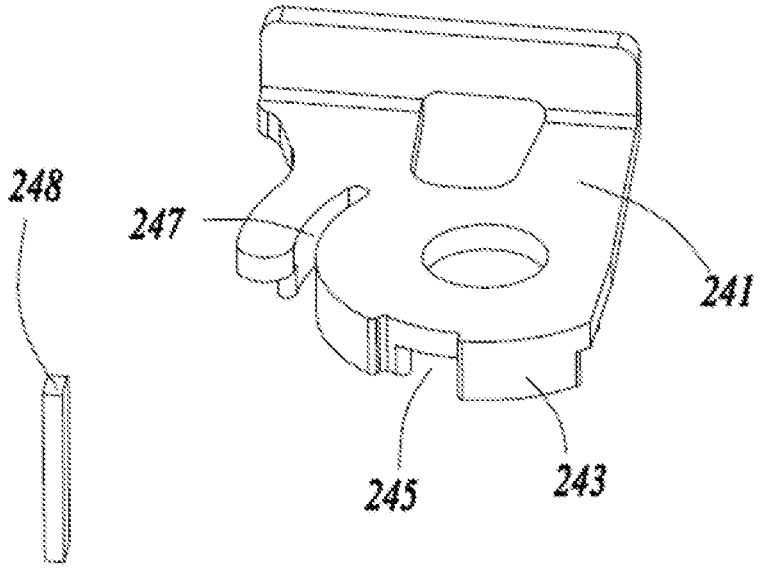
FIG. 7*b* illustrates a stereoscopic schematic structural diagram of a guiding slider from another visual angle in a specific embodiment of the present invention.

As shown in FIGS. 7*a* and 7*b*, the guiding slider 24 in the present embodiment is mounted below the hinge 22. The guiding slider 24 comprises a fifth main body portion 241, and a third limiting member 242 and a fourth limiting member 243 which are located on the fifth main body portion 241. The third limiting member 242 and the fourth limiting member 243 are in an arc shape respectively, and a second guiding groove 244 which allows the guiding member 123 on the gear 12 to slide is formed between the third limiting member 242 and the fourth limiting member 243. Meanwhile, a third opening 245 is formed on the side of the fourth limiting member 243. The guiding member 123 may be disengaged from the guiding slider through the third opening 245 when moving to the third opening 245 along the second guiding groove.

Further, a third guiding groove 247 is also formed on the side of the fifth main body portion 241. A limiting structure on the side of the third guiding groove is limited by the third limiting member 225 on the hinge 22. Correspondingly, as shown in FIG. 5*b*, a cylindrical guide pillar 2110 is arranged on the lower surface of the rack. The guide pillar 2110 moves within the third guiding groove 247 having an arc shape, to further limit the movement of the rack.

In the present embodiment, a protrusion 246 is also arranged on the fifth main body portion 241 in a vertically upward manner. The protrusion 246 is in a "Π" shape which corresponds to the shape of the second accommodating groove 224. The protrusion 246 may extend out of the second accommodating groove 224. A third attracting portion 248 is also arranged in the protrusion 246. The third attracting portion 248 has the same principle as the first attracting portion and the second attracting portion and may be made of a magnet. As shown in FIG. 5*a*, the fourth extension portion 219 on the rack is provided with a rectangular accommodating groove whose shape corresponds to the size of the protrusion. The fourth extension portion 219 may be made of a metal material (e.g., iron) that can be attracted by the magnet. When the fourth extension portion 219 on the rack is adjacent to the third attracting portion 248 on the guiding slider 24, the third attracting portion 248 can attract the fourth extension portion 219. In the same way, the rack may also be entirely made of a metal material, and the purpose of attracting with the third attracting portion 248 may also be achieved.

By reference to FIGS. 8*a* to 8*c* and 9*a* to 9*c* and as shown in FIGS. 1 to 7*b*, the present embodiment will be further described by taking a case where the door is opened from the right side as an example.

Figure 8A:
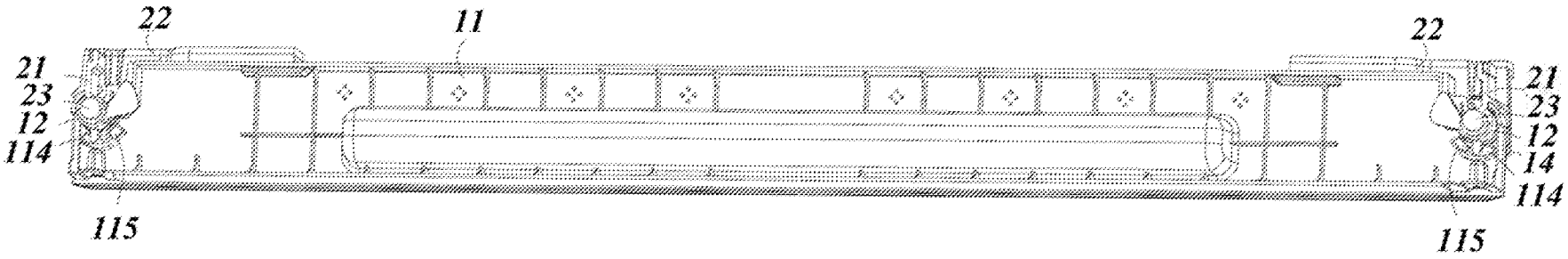
FIG. 8*a* illustrates a stereoscopic schematic structural diagram when the left-right door opening mechanism is in a locked state in a specific embodiment of the present invention.
Figure 8B:
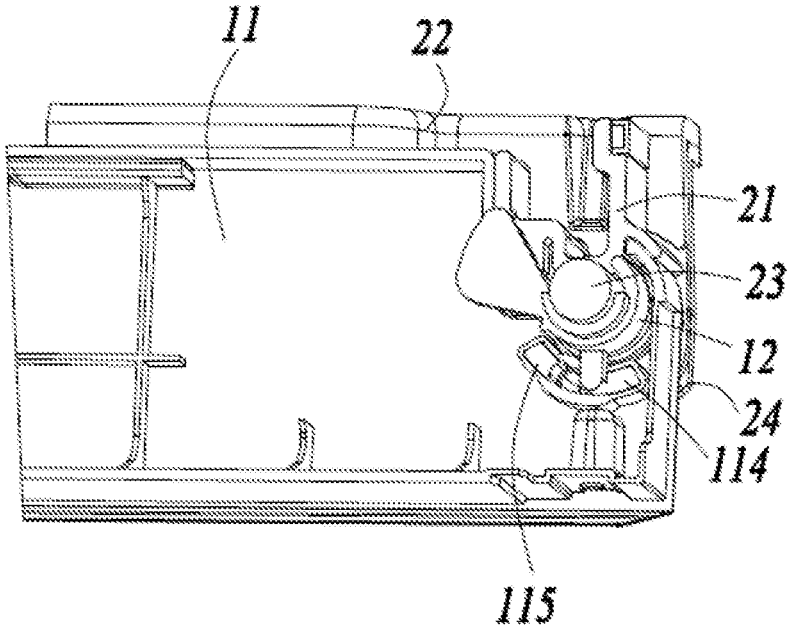
FIG. 8*b* is a partially enlarged schematic diagram of the right side in FIG. 8*a;*
Figure 8C:
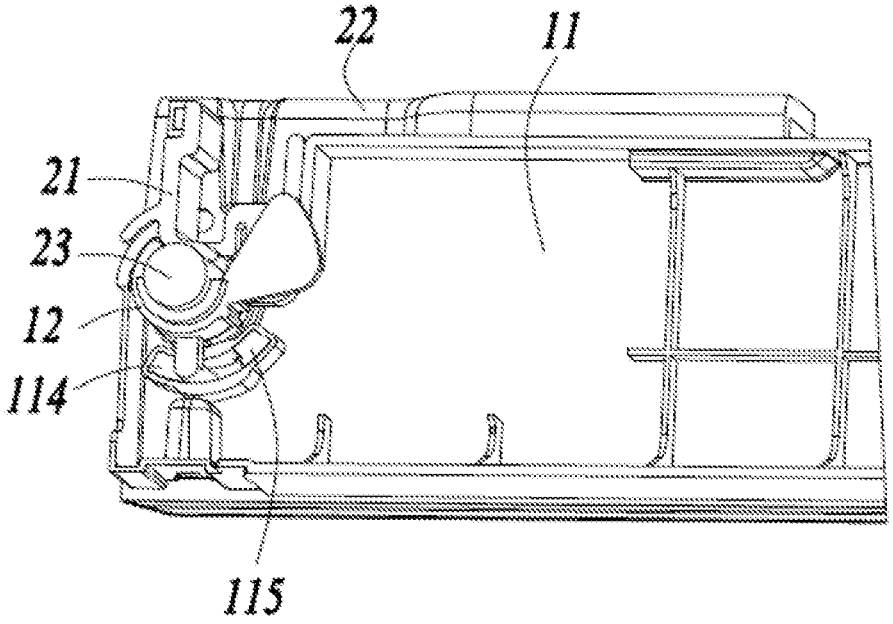
FIG. 8*c* is a partially enlarged schematic diagram of the left side in FIG. 8*a;*

By reference to FIGS. 8*a* to 8*c* and as shown in FIGS. 1 to 7*b*, the left-right door opening mechanism is in a locked state, and the gears on the left side and the right side in this case are meshed with the racks respectively. The guiding member 123 on the right gear 12 is located on the right end of the first guiding groove 113 on the mounting bottom plate 11. The guiding member 123 is attracted with the first attracting portion 114 on the right end. The guiding member 123 on the left gear 12 is located on the left end of the first guiding groove 113 on the mounting bottom plate 11. The guiding member 123 is attracted with the first attracting portion 114 on the left end. The left gear and the right gear are fixedly arranged, respectively.

Meanwhile, the guide pillar 2110 located below the rack 21 is accommodated on the innermost side of the third guiding groove 247 on the guiding slider 24. The third extension portion 218 and the fourth extension portion 219 on the rack 21 abut against the side wall of the mounting bottom plate 11 and the protrusion 246 on the guiding slider 24 respectively to keep the rack relatively fixed. In addition, the buckling portion 125 on the rack 21 is fixedly clamped with the limiting portion 216 on the rack 21, so as to further ensure that the gear and the rack are fixed.

Figure 9A:
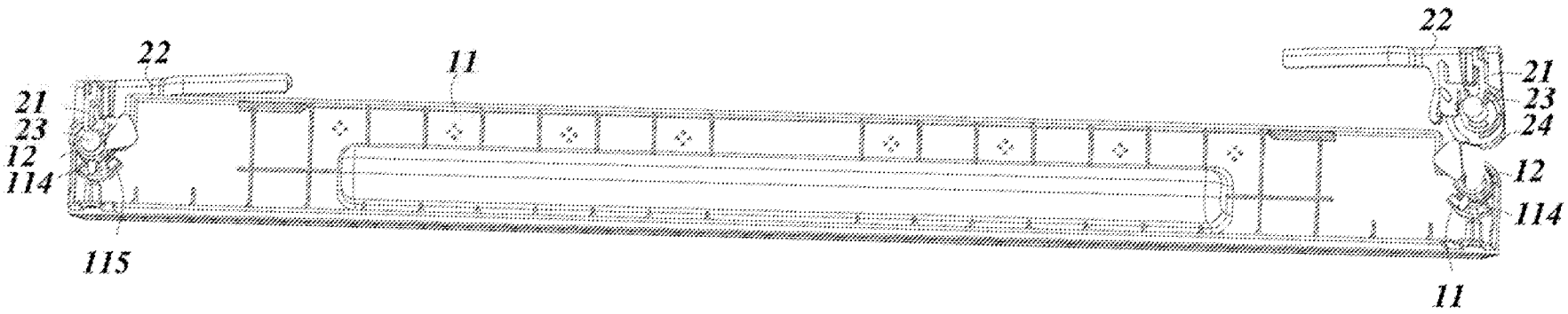
FIG. 9*a* illustrates a stereoscopic schematic structural diagram when the left-right door opening mechanism is in an opened state on the right side in a specific embodiment of the present inventions.
Figure 9B:
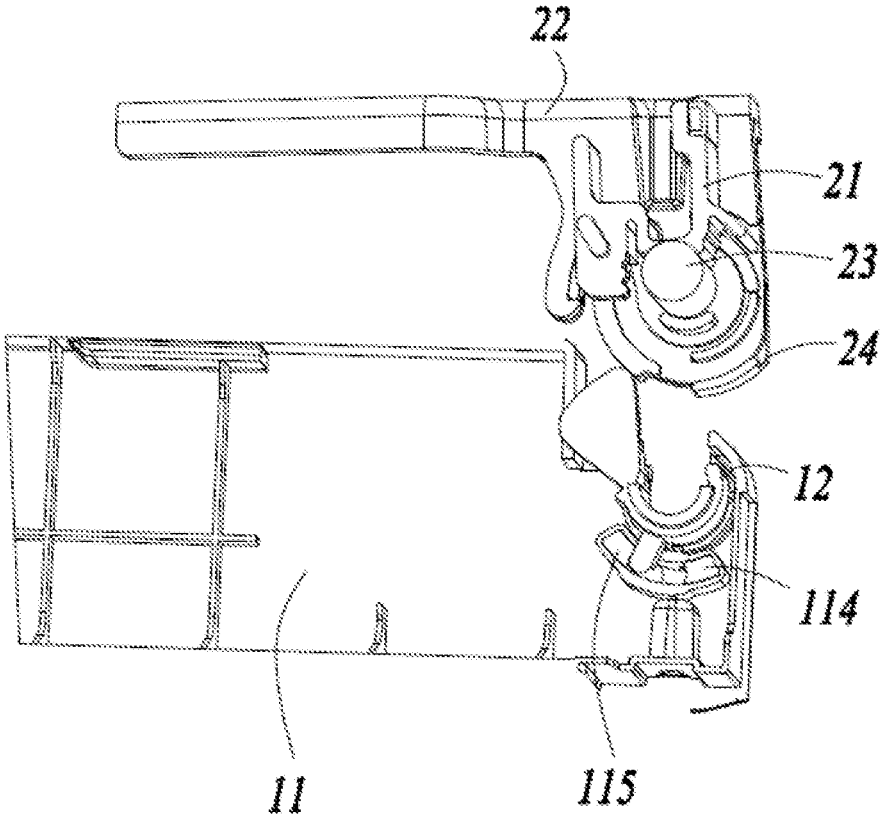
FIG. 9*b* is a partially enlarged schematic diagram of the right side in FIG. 9*a*.
Figure 9C:
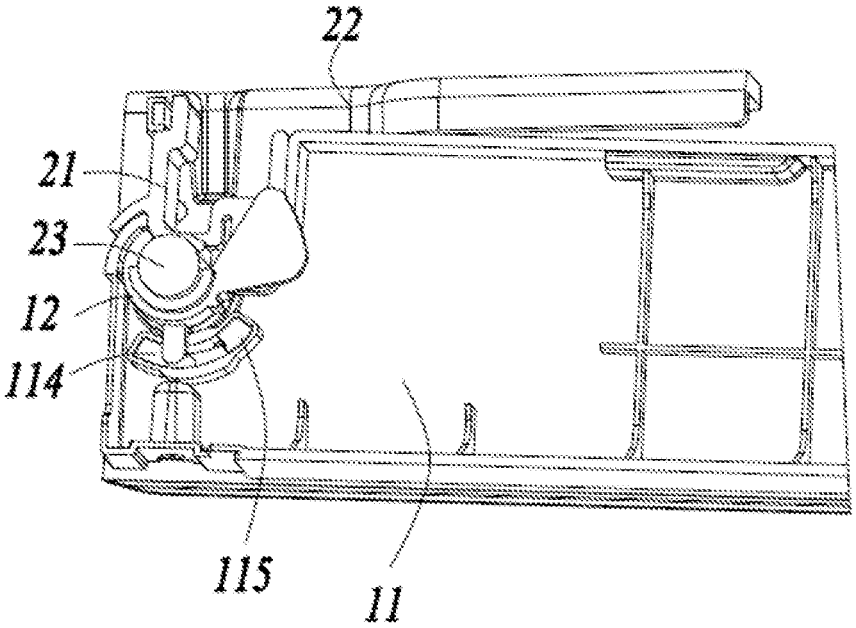
FIG. 9*c* is a partially enlarged schematic diagram of the left side in FIG. 9*a*.

By reference to FIGS. 9*a* to 9*c* and as shown in FIGS. 1 to 7*b*, when the left-right door opening mechanism is opened from the right side, an outward force is applied to the first module from the right side. In this case, in the left-right door opening mechanism on the right side, the rack 21 remains unchanged in relative position due to the limiting effect of the protrusion 246 on the guiding slider 24. The gear 12 and the rack 21 are in transmission by means of the first tooth portion 126 and the second tooth portion 217. The gear 12 may rotate clockwise. The buckling portion 125 on the gear 12 is gradually separated from the limiting portion 216 on the rack 21. The guiding member 123 on the gear 12 is disengaged from the attraction of the first attracting portion 114 and moves clockwise in the first guiding groove 113 on the mounting bottom plate 11 from the first attracting portion 114 to the second attracting portion 115. Meanwhile, the lower end of the guiding member 123 rotates clockwise along the third guiding groove 244 on the guiding slider 24. The second opening 122 on the gear 12 gradually rotates clockwise along the rotating shaft 23. After the second opening 122 rotates by an angle, the rotating shaft 23 may be separated from the second opening 122. Meanwhile, when the guiding member 123 rotates clockwise to the third opening 245 along the second guiding groove 244, the guiding member 123 may also be separated from the guiding slider 24.

When the rotating shaft 23 is separated from the second opening 122 on the gear 12 and after the guiding member 123 is separated from the guiding slider through the third opening 245, the gear 12 may be completely separated from the rack 21. The guiding member 123 on the gear 12 in this case moves to the leftmost side of the first guiding groove 113, and is attracted with the second attracting portion 115. The mounting bottom plate 11 and the gear are fixed on the door body. The rack 21, the hinge 22, the rotating shaft 23 and the guiding slider 24 are fixed on the refrigerator body, and therefore the door body and the refrigerator body can be opened by rotating along the rotating shaft on the left side.

When the left-right door opening mechanism is opened from the right side, in the left-right door opening mechanism on the left side, the gear 12 and the rack 21 remains relatively fixed and rotate clockwise on the mounting bottom plate 11 along with the door body. The guiding member 123 on the gear 12 in this case rotates on the guiding slider 24 along the third guiding member 244 in a direction away from the third opening 245. The rack 21 also rotates clockwise along the guiding slider 24, and then the second opening 122 on the gear 12 gradually locks the rotating shaft 23, thereby ensuring that the rotating shaft 23 on the left side is not disengaged from the openings of the gear and the rack. The rotating shaft 23 on the left side acts as the rotating shaft when the door is opened from the right side.

When the door is locked from the right side, the transmission direction of the gear and the rack is opposite from the transmission direction when the door is opened from the right side, will not be described in detail here.

In the present embodiment, a description will be made by taking the case where the door is opened from the right side as an example. Similarly, when the door is opened from the left side, the gear and the rack on the left side are in transmission to gradually expand the second opening on the gear, such that the rotating shaft on the left side is separated from the gear. The guiding member on the left gear rotates to the third opening along the guiding slider, and may be then separated from the guiding slider, thereby achieving the purpose of separating the first module from the second module on the left side. In this case, there is no relative movement between the gear and the rack on the right side. The gear and the rack rotate simultaneously along with the mounting bottom plate. The second opening on the right gear gradually locks the rotating shaft. The rotating shaft on the right side acts as the rotating shaft when the door is opened from the left side. The principle of opening the door from the left side is the same as the principle of opening the door from the right side, and will not be described here.

Similarly, when the door is locked from the left side, the transmission direction of the gear and the rack is opposite to the transmission direction when the door is opened from the left side, and will not be described here in detail.

The left-right door opening mechanism in the present embodiment is described by taking a refrigerator as an example. In other embodiments, the left-right door opening mechanism may be applied to any device comprising a door body and a refrigerator body, such as a wine cabinet, etc., and will not be described in detail here.

As can be seen from the above technical solution, the present invention has the following beneficial effects:

the first modules and the second modules, which cooperate with each other, are arranged on two sides of the door body and on two sides of the refrigerator body, and therefore, the door can be opened from the left side and the right side at the same time;

it is ensured that the door opening and closing process is smooth and free of blocking and impact noise. The door body is unlikely to fall off during the opening and closing process, and provides an excellent use experience for a user.

It should be understood that although the description is described based on the embodiments, not every embodiment includes only one independent technical solution. This statement of the description is only for clarity. Those skilled in the art should treat the description as a whole, and technical solutions in all of the embodiments may also be properly combined to form other embodiments that will be understood by those skilled in the art.

The above detailed description only aims to specifically illustrate the available embodiments of the present invention, and is not intended to limit the protection scope of the present invention. Equivalent embodiments or modifications thereof made without departing from the spirit of the present invention shall fall within the protection scope of the present invention.

What is claimed is:

1. A mechanism for opening a door on either a left side of the door or a right side of the door, comprising a pair of first modules arranged symmetrically about a center line of the door on the left side and the right side of the door, a mounting bottom plate fixedly mounted on the door and having two ends respectively located at the left and right sides of the door, and a pair of second modules arranged symmetrically about a center line of a refrigerator body on a left side and a right side of the refrigerator body, wherein each first module comprises a gear, the gears of the pair of first modules are respectively rotatably mounted on the two ends of the mounting bottom plate; each first module comprises an opening; each second module comprises a rack configured to be engaged with a corresponding one of the gears of the pair of first modules, a hinge, a rotating shaft, and a guiding slider for guiding a rotation of the corresponding one of the gears of the pair of first modules; each of the hinges has a respective one of the rotating shafts and a respective one of the guiding sliders mounted thereon; wherein a portion of each of the hinges is sandwiched between a respective one of the racks and the respective one of the guiding sliders; and each of said racks is fixed on a respective one of the hinges; when the door is in a closed state relative to the refrigerator body, the gears of the pair of first modules are respectively engaged with the racks of the pair of second modules and the rotating shafts of the pair of second modules are respectively located in the openings of the pair of first modules; when the door is opened from the right side of the door, the gear on the right side of the door is driven by the rack on the right side of the refrigerator body, and the rotating shaft on the right side of the refrigerator body is removed from the opening of the first module on the right side of the door, such that the rotating shaft on the right side of the refrigerator body is disengaged from the first module on the right side of the door; meanwhile, the rotating shaft on the left side of the refrigerator body is still located in the opening of the first module on the left side of the door.

2. The mechanism according to claim 1, wherein the gears are symmetrically mounted on the mounting bottom plate; the racks, the hinges, the rotating shafts and the guiding sliders are symmetrically mounted on the refrigerator body; when the door is opened from the left side of the door, the gear on the left side of the door rotates in a direction, when the door is opened from the right side of the door, the gear on the right side of the door rotates in the direction.

3. The mechanism according to claim 1, wherein the opening of each of the first modules comprises a second opening in a respective one of the gears; each of the two ends of the mounting bottom plate includes a first main body portion having an arc shape and a first opening that faces a corresponding one of the rotating shafts of the pair of second modules; each of the gears is provided with a second main body portion having an arc shape; the second main body portions rotate around a corresponding one of the first main body portions on the mounting bottom plate; each of the second openings face a corresponding one of the rotating shafts of the pair of second modules.

4. The mechanism according to claim 3, wherein a guiding member extends downwards from each of the second main body portions; each of the two ends of the mounting bottom plate includes a guiding groove having an arc shape; each of the guiding members moves along a corresponding one of the guiding grooves on the mounting bottom plate.

5. The mechanism according to claim 1, wherein each of the guiding sliders is provided with a plurality of limiting members or guiding grooves which are used for limiting movement of or guiding the corresponding one of the gears of the pair of first modules, and an attracting portion for attracting a respective one of the racks.

6. The mechanism according to claim 5, wherein each of the hinges is provided with a plurality of accommodating grooves to limit movement of the respective one of the racks and the respective one of the guiding sliders.

7. A refrigerator, comprising the mechanism according to claim 1.

* * * * *